US006702107B1

(12) United States Patent
Raz

(10) Patent No.: US 6,702,107 B1
(45) Date of Patent: Mar. 9, 2004

(54) DOOR POST-ATTACHABLE HOUSING FOR A PARCHMENT SCROLL

(76) Inventor: Zeev Raz, 11 Harduf Street, Omer 84965 (IL)

( * ) Notice: Subject to any disclaimer, the term of this patent is extended or adjusted under 35 U.S.C. 154(b) by 0 days.

(21) Appl. No.: 10/251,985

(22) Filed: Sep. 23, 2002

(51) Int. Cl.[7] ..... A45C 11/00

(52) U.S. Cl. ..... 206/19; D99/25; 206/39.8; 206/232; 248/205.3

(58) Field of Search ..... 248/205.1, 205.3; 206/19, 232, 39.8; D99/25

(56) References Cited

U.S. PATENT DOCUMENTS

| | | | | | |
|---|---|---|---|---|---|
| D166,400 | S | * | 4/1952 | Lawsky | D99/25 |
| 4,260,090 | A | * | 4/1981 | Gross | 224/277 |
| 4,691,891 | A | * | 9/1987 | Dionne | 248/551 |
| 6,006,900 | A | * | 12/1999 | Hasten | 206/19 |
| D419,746 | S | * | 1/2000 | Charny | D99/25 |
| 6,546,657 | B2 | * | 4/2003 | Gray | 40/643 |

FOREIGN PATENT DOCUMENTS

| | | | | |
|---|---|---|---|---|
| FR | 2689672 | * | 10/1993 | 704/258 |

* cited by examiner

*Primary Examiner*—Ramon O. Ramirez
(74) *Attorney, Agent, or Firm*—Renner, Otto, Boisselle & Sklar, LLP

(57) ABSTRACT

A door post-attachable housing for a mezuza scroll, has a base component for attachment to a door post and a cover component, the base and cover delimiting a compartment for housing a mezuza scroll. The base component is provided with fasteners for separate attachment thereof to a door post and with an open top compartment extending into the housing compartment to retain and support the mezuza scroll in rolled-up configuration. The cover component is provided with arms or recesses corresponding to opposing recesses or arms on the base component for removable engagement of the cover component with the base component. The cover component is provided with an outer surface and wall surfaces extending therefrom towards the base component to delimit the housing compartment and to cover the scroll and at least a major portion of the base component.

9 Claims, 2 Drawing Sheets

DOOR POST-ATTACHABLE HOUSING FOR A PARCHMENT SCROLL

FIELD OF INVENTION

The present invention relates to protective casings for attachment to a vertical surface. More particularly, the present invention relates to a door post-attachable housing for a small roll of religious text written on parchment, known as a mezuza, which according to Jewish law is to be attached to a vertical component of a door frame.

BACKGROUND OF THE INVENTION

A mezuza is a small roll of parchment on which are handwritten in Hebrew two paragraphs from the book of Deuteronomy. The requirement to attach said parchment to door posts is accepted not only by orthodox Jews, but also by a many others who believe that the mezuza provides divine protection. The text of the mezuza needs to conform to a number of regulations, among them that the ink has not peeled off from the parchment even for a single letter.

Although the metal, wooden or plastic elongated two-part housing protects the parchment to some extent, nevertheless it is customary to open the housing at least once every three years to check that the mezuza remains in good condition since with time the parchment and ink undergo a further drying process which can result in one or more letters on the rolled up parchment peeling off therefrom.

The mezuza housings commonly in use are usually provided with a small hole near each extremity which is used to nail the mezuza to a wooden door post. After attachment to the wall it is generally not possible to open the casing without detaching the whole assembly from the door post, as typically the nails, or the screws used for metal doorways, also hold the outer part of the housing. Consequently examination of the mezuza requires removing the casing from the door frame, and replacing same after the mezuza has been checked or repaired. Removal and replacement of the casing requires tools and these actions are very likely to damage and/or to scratch the casing, door frame surface or both.

Mezuza housings can be categorized as being intended for out doors or for internal use. Mezuza housings for external use typically require protection against the elements and usually also against unauthorized removal. Housings for internal home use are aesthetically pleasing; an excellent example thereof being seen in U.S. Design No. DES. 419,746 to Charny. However indoors there is usually no need to secure the housing or any part thereof to prevent unwanted removal, particularly as the housing is affixed at a height out of reach of small children. Depending on where the mezuza is located, there may or may not be a need for environmental protection.

One type of mezuza housing utilizes a test-tube type of glass container to display the parchment scroll, however, these are problematic since the glass is too easily broken, accidentally or deliberately, and the mezuza is too easily removed even without glass breakage.

It is therefore one of the objects of the present invention to obviate the disadvantages of prior art mezuza casings and to provide a housing which can be opened for purposes of checking and replacing the parchment scroll while allowing the base component of the housing to remain permanently attached to the door post.

It is a further object of the present invention to provide an embodiment suitable for attachment to an external door post.

With this state of the art in mind there is now provided according to the present invention a door post-attachable housing for a mezuza scroll, of the type having a base component for attachment to a door post and a cover component, said base and cover delimiting a compartment for housing a mezuza scroll, characterized in that said base component is provided with means for separate attachment thereof to a door post and with support means extending into said compartment to retain and support said mezuza scroll in rolled-up configuration, and said cover component is provided with means for removable inter-engagement with said base component, said cover component being provided with an outer surface and wall surfaces extending therefrom towards said base component to delimit said housing compartment and to cover said scroll and at least a major portion of said base component In a first preferred embodiment of the present invention, there is provided a mezuza openable casing comprising of at least two parts, a base and a cover, wherein at least one of said components includes a receptacle which is open relative to the remaining component, the base component being provided with means for permanent attachment to a door post, said base component and said cover being interconnected by at least one catch element which serves to retain the two components together and yet allows easy opening of the cover.

Thus, in a preferred embodiment of the present invention, said cover component is connectable to said base component by interlocking arms and matching recesses for removal and replacement of said cover component without the need for tools.

In another preferred embodiment of the present invention, said cover component is connectable to said base component by interlocking friction fit means.

In a most preferred embodiment of the present invention there is provided door post-attachable housing for a mezuza scroll further provided with means to deter unauthorized removal of said cover.

Yet further embodiments of the invention will be described hereinafter.

In U.S. Pat. No. 6,006,900 Hasten describes and claims a mezuza having a base which is permanently mountable on a doorway fixture, and having a housing portion with a bore portion with a bore in one of its ends for receiving a scroll bearing biblical text therein, with the housing member being slidably engageable with the doorway mounted elongated base member. The lower, bore communicating end of the housing member abuts a sealing member of the base member upon engagement of the housing to the base member to effectively seal the bore in which the scroll is disposed to prevent the scroll from falling out and to shelter the scroll. The scroll may be periodically checked for integrity or replaced by sliding the housing member off of the base member to gain easy access to the bore, with the housing member then slideable back onto the base member to secure the scroll in the housing member. A latch may be provided to selectively prevent slideable disengagement of the housing member from the base member.

The parchment scroll is difficult to remove from the bore, tweezers being required for this purpose. Regarding opening of the housing, the long dovetail slide may not operate freely due to dirt, paint, or distortion of the wood due to humidity changes. If a latch is provided, and it is easily opened, a potential thief can also open the housing. If the latch is difficult to open, the householder will have a problem when trying to open the casing for inspection of its contents.

Alternatively, if said housing were to be modified so that the parchment scroll would be easily removable from the bore then the danger would exist that when the housing portion containing the scroll were removed from the base member then the scroll could fall therefrom thereby desecrating its holiness.

In contradistinction thereto, the present invention allows for much easier access for removal of the scroll from its casing. For indoor use, no latch need be provided. For outdoor use, the present invention provides at least three solutions: a double catch which the householder knows how to open but which is not easily opened otherwise; a miniature lock; and lastly one or two tamper resistant screws which can only be opened by use of a non-standard key which is supplied together with the mezuza housing.

Furthermore, since the base component of the housing of the present invention is provided with support means extending into said compartment to retain and support said mezuza scroll in rolled up configuration even after the removal of the cover component, the danger of the scroll failing on the floor when the housing is opened is eliminated.

It will thus be realized that the novel housing of the present invention allows permanent attachment of the base portion to the door frame, thus making possible the use of liquid adhesives as well as double-sided adhesive tape. Consequently the attachment holes in the base portion can be eliminated, and the danger of damaging the housing while driving nails or screws into the door frame is obviated.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

DETAILED DESCRIPTION OF PREFERRED EXEMPLARY EMBODIMENTS

Figure 1:
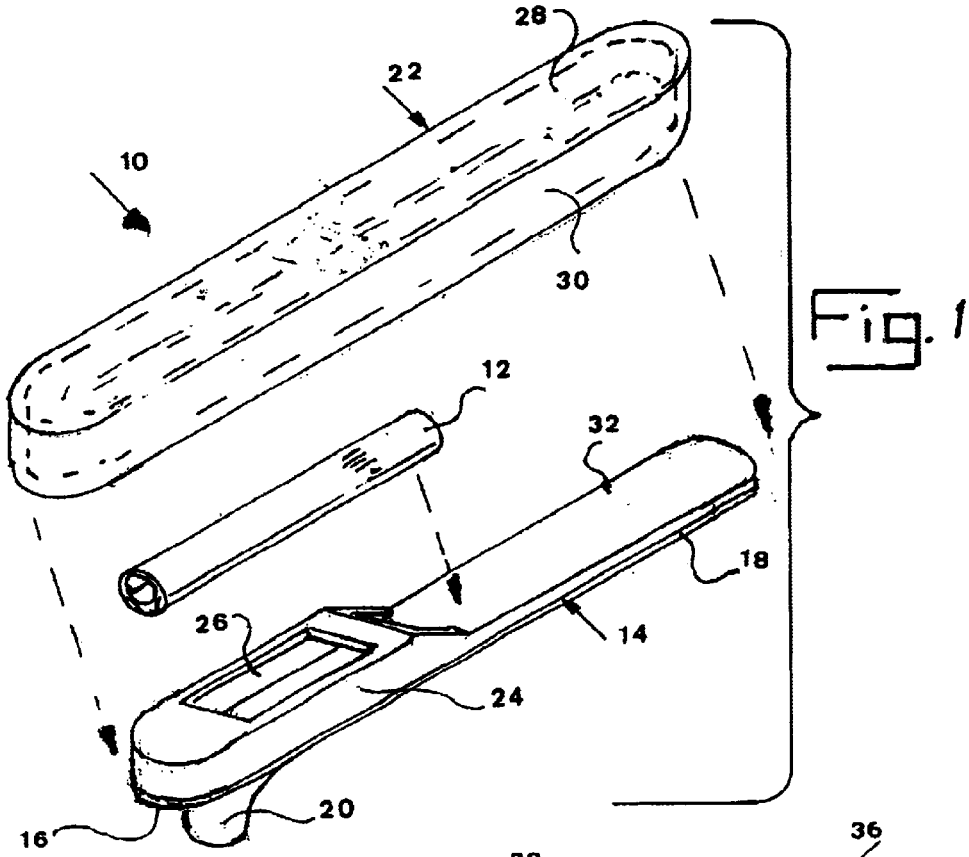
FIG. 1 is an exploded perspective view of a preferred embodiment of the housing according to the invention.

There is seen in FIG. 1 a door post-attachable housing 10 for a mezuza scroll 12. When rolled into a scroll, the parchment is typically about 5–10 mm diameter and about 5–18 cm high. The housing 10 contains and protects the scroll.

A base component 14 is arranged for permanent attachment to a door post (not shown), in the present embodiment by means of a pressure-sensitive adhesive 16 on its lower face 18, the adhesive 16 being protected before use by a release paper 20. The base component 14 is provided with means for separate attachment thereof to a door post, and remains attached to the door post whether or not the cover component 22 is placed thereover.

The base component 14 is provided with support means, such as the open top 26 compartment 24 seen in the figure. The compartment 24 extends above the lower face 18 to retain and support the mezuza scroll 12 therein in its rolled-up configuration.

A cover component 22 delimits the compartment for housing the mezuza scroll 12. The cover component 22 is provided with means for removable inter-engagement with the base component 14, in the present embodiment by interlocking friction fit means. The cover component 22 can thus be removed at any time by firmly grasping and pulling same outwards.

The cover component 22 is provided with an outer surface 28 and wall surfaces 30 extending therefrom towards the base component 14 to delimit the housing compartment and to cover the scroll 12 and the base component 14. The outer edges 32 of the base component 14 are a close fit inside the wall surfaces 30 of the cover component 22, to provide adequate resistance to inadvertent disengagement.

With reference to the rest of the figures, similar reference numerals have been used to identify similar parts.

Figure 2:
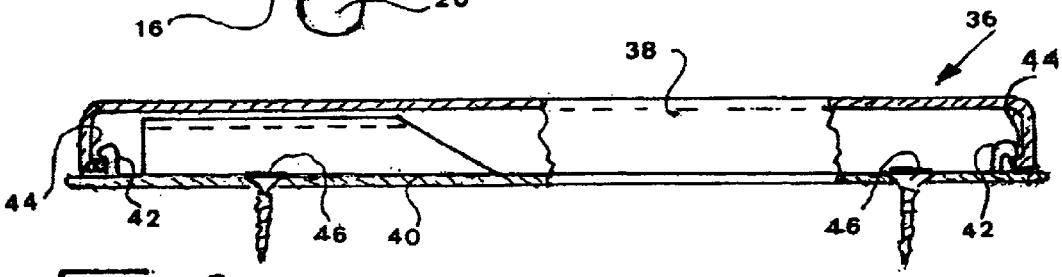
FIG. 2 is a partially section elevational cross-sectional view of a second embodiment.

Referring now to FIG. 2, there is seen a second embodiment of the door post-attachable housing 36 for a mezuza scroll 12 seen in FIG. 1.

The cover component 38 is shown removably connected to the base component 40 by a pair of arms 42 which match recesses 44 in the cover component 38. In the diagram the arms 42 and recesses 44 are seen at the extreme ends of the cover component 38. They can however be positioned anywhere along the perimeter of the housing 36.

When the cover component 38 is grasped by hand for removal and replacement thereof, the arms 42 and recesses 44 yield slightly. Thus no tools are required for these purposes.

In the present embodiment the cover component 38 is transparent. The cover component 38 is preferably made of a material resistant to UV deterioration, for example an acrylic thermoplastic. Although the housing 36 is intended for indoors use, some exposure to solar radiation must nevertheless be expected, depending of course on the house layout and mezuza position.

Preferably the base component 40 as seen through the cover 38 is decoratively arranged to uphold the attractive appearance of the housing 36.

It will be noted that the cover component 38 is extended to cover the fastener heads 46 used for permanently affixing the base component 40 to the door post. This helpful for improving appearance. After initial installation there is no need to access the fasteners 46.

Figure 3:
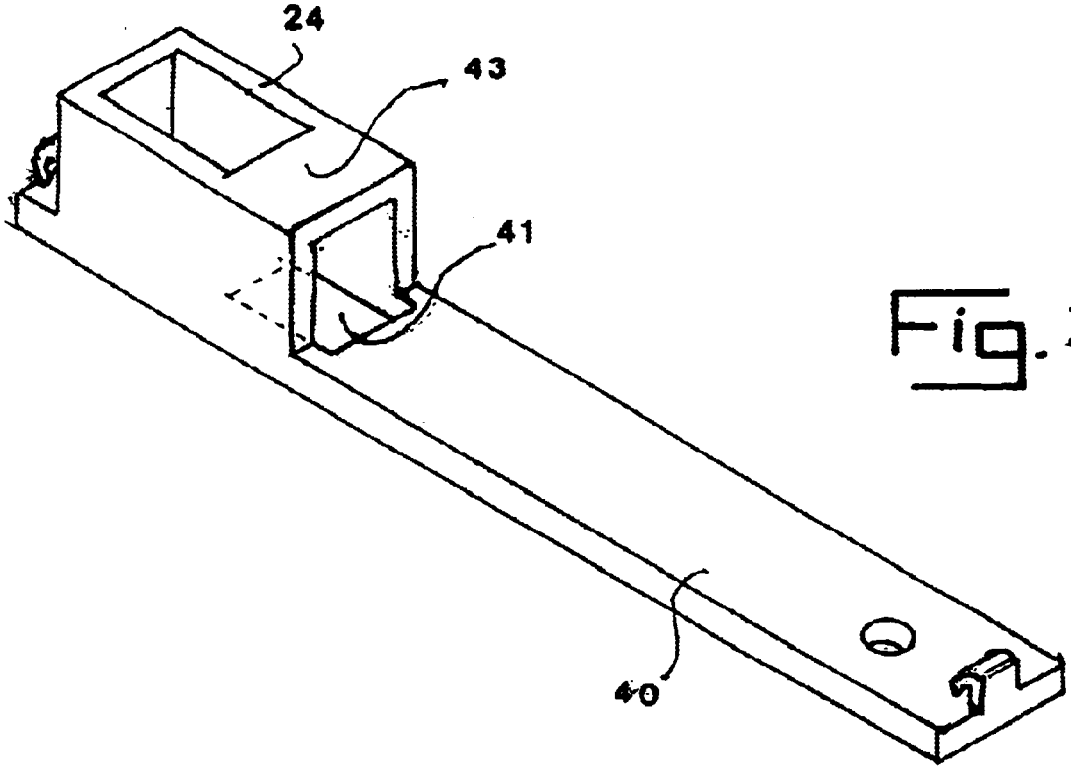
FIG. 3 is a perspective view of another variation of the second embodiment shown in FIG. 2.

Referring to FIG. 3, there is seen another variation of the base element 40 of FIG. 2 in perspective partially rotated view in order to show a preferred embodiment wherein said base component 40 is provided with an opening 41 positioned opposite upper frame member 43 of compartment 24 to facilitate simple injection molding of this element. As shown in FIG. 3, the orientation of the pair of arms 42 may be reversed. In this variation, recesses (not shown) matching reversed arms 42 are formed at the extreme outer ends of the cover component.

Figure 4:
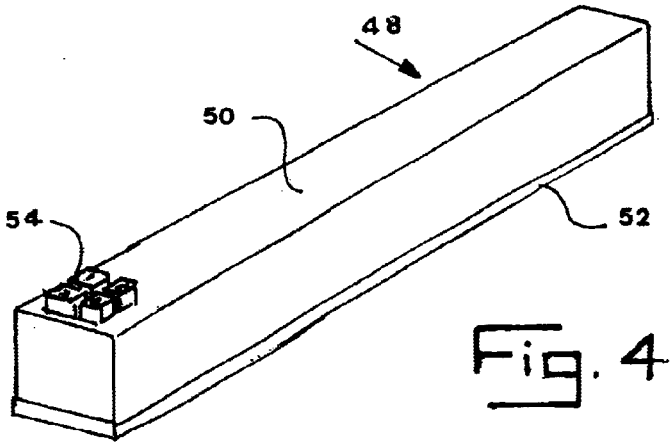
FIG. 4 is a perspective view of an embodiment provided with a lock.

FIG. 4 illustrates a door post-attachable housing 48 for a mezuza scroll 12 seen in FIG. 1, intended for use outside a house or apartment. In order to reduce the risk of theft of the mezuza scroll 12, the housing 48 is provided with means to deter unauthorized removal of the cover 50.

The figure shows an embodiment wherein the cover 50 is secured to the base component 52 by means of a miniature lock 54. The lock 54 shown is a combination lock. In another embodiment (not shown) the lock is key operated.

It will be evident to those skilled in the art that the invention is not limited to the details of the foregoing illustrative embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A door post-attachable housing for a mezuza scroll, of the type having a base component for attachment to a door post and a cover component, said base and cover delimiting a compartment for housing a mezuza scroll, characterized in that said base component is provided with means for separate attachment thereof to a door post and with support means extending into said compartment to retain and support said mezuza scroll in rolled-up configuration, and said cover component is provided with means for removable inter-engagement with said base component, said cover component being provided with an outer surface and wall surfaces extending therefrom towards said base component to delimit said housing compartment and to cover said scroll and at least a major portion of said base component.

2. A door post-attachable housing for a mezuza scroll according to claim 1, wherein said cover component is connectable to said base component by interlocking arms and matching recesses for removal and replacement of said cover component without the need for tools.

3. A door post-attachable housing for a mezuza scroll according to claim 1, wherein said cover component is connectable to said base component by interlocking friction fit means.

4. A door post-attachable housing for a mezuza scroll according to claim 1, wherein said support means is an open top compartment extending into said housing for supporting said mezuza scroll therein.

5. A door post-attachable housing for a mezuza scroll according to claim 1, further provided with means to deter unauthorized removal of said cover.

6. A door post-attachable housing for a mezuza scroll according to claim 5, wherein said means comprises a miniature lock.

7. A door post-attachable housing for a mezuza scroll according to claim 1, wherein, wherein said base component is decoratively arranged and said cover member is transparent.

8. A door post-attachable housing for a mezuza scroll according to claim 1, wherein said cover component is extended to cover heads of fasteners used for affixing said base component to said door post.

9. A door post-attachable housing for a mezuza scroll according to claim 1, wherein said cover component is made of a material resistant to UV deterioration.

* * * * *